United States Patent [19]

Yamagami

[11] 4,423,654

[45] Jan. 3, 1984

[54] TONE CONTROL

[75] Inventor: Takayoshi Yamagami, Matsumoto, Japan

[73] Assignee: Matsumoku Kogyo Kabushiki Kaisha, Matsumoto, Japan

[21] Appl. No.: 384,177

[22] Filed: Jun. 2, 1982

[30] Foreign Application Priority Data

Dec. 8, 1981 [JP] Japan ..... 56-181710[U]

[51] Int. Cl.[3] ..... G10H 3/00

[52] U.S. Cl. ..... 84/1.15; 84/1.16

[58] Field of Search ..... 84/1.14, 1.15, 1.16

[56] References Cited

U.S. PATENT DOCUMENTS

| | | | |
|---|---|---|---|
| 2,897,709 | 8/1959 | McCarty et al. | 84/1.15 |
| 3,472,943 | 10/1969 | Kawabata et al. | 84/1.15 |
| 3,483,303 | 12/1969 | Warner | 84/1.15 |
| 3,742,113 | 6/1973 | Cohen | 84/1.15 |
| 3,915,048 | 10/1975 | Stich | 84/1.15 |
| 4,164,163 | 8/1979 | Rhodes | 84/1.15 |
| 4,188,849 | 2/1980 | Rickard | 84/1.15 |
| 4,222,301 | 9/1980 | Valdez | 84/1.15 |

*Primary Examiner*—F. W. Isen

*Attorney, Agent, or Firm*—Wenderoth, Lind & Ponack

[57] ABSTRACT

This invention discloses a tone control for an electromagnetic pick-up for a stringed musical instrument wherein the electromagnetic pick-up comprises at least a pair of coils and a magnet, comprising means for gradually switching the mutual connection between the coils from parallel to series or vice versa, the switching means comprising at least a ganged pair of rheostats of high rated resistance wherein at one extreme of travel of the sliding members of the ganged potentiometers the coils are connected in parallel and at the other extreme they are connected in series, and at intermediate positions a combination of parallel and series connection output components is outputted.

4 Claims, 3 Drawing Figures

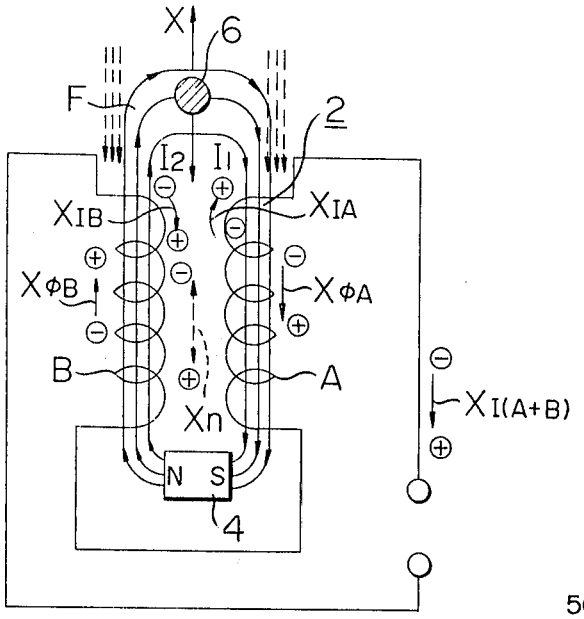
FIG. 1
FIG. 3
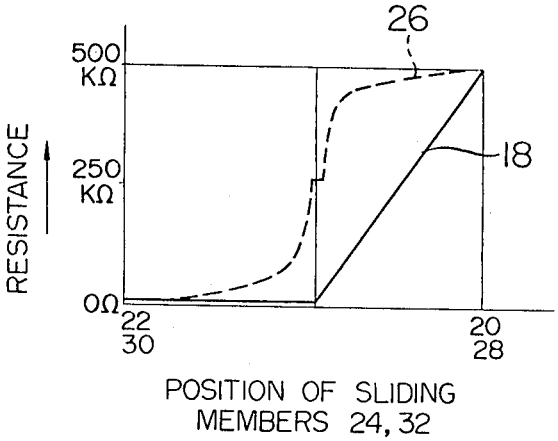
FIG. 2
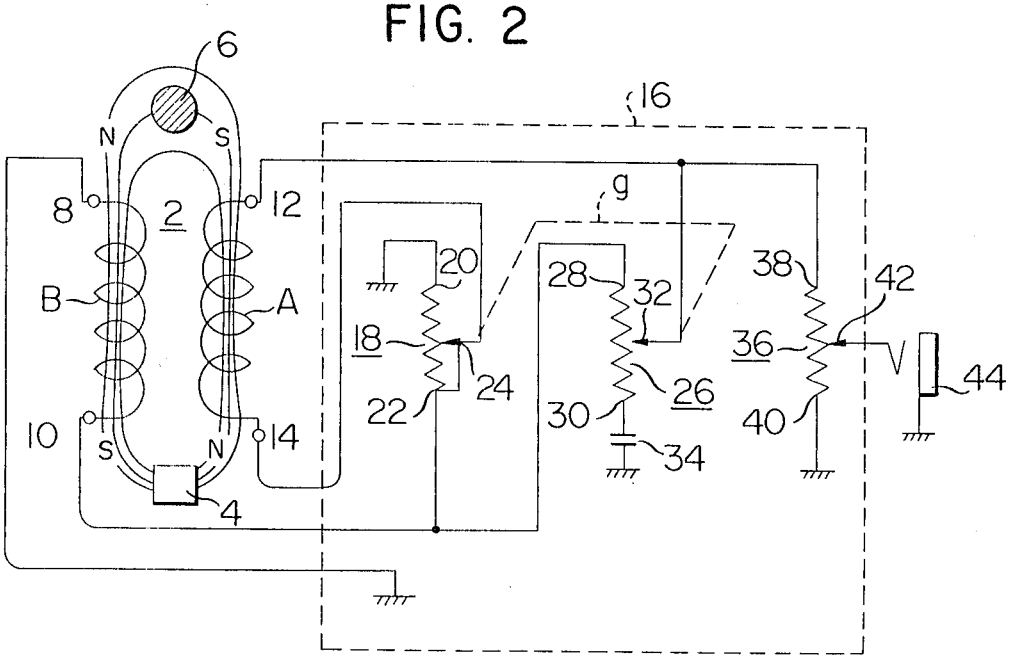

TONE CONTROL

BACKGROUND OF THE INVENTION

This invention relates to the electromagnetic pick-ups for stringed musical instruments such as guitars, and in particular relates to a tone control for such pick-ups.

With an electromagnetic pick-up for a stringed musical instrument such as a guitar, it is a feature that the quality and quantity of the sound output can be controlled electrically, in addition to any tonal characteristics possessed by the instrument itself. Normal capacitive element based tone control circuits may be employed, and electrical attenuation may be achieved by means of a rheostat. Additionally, amplification and other sophisticated electronic effects may be achieved by means of suitable electronic circuitry. However, one simple means for altering the tone color of the electrical output from the pick-up has involved switching the connection between the two coils ordinarily used in such pick-ups such that the coils are connected either in series or in parallel. In prior art tone controls, however, this switching has been effected by means of switches which meant that only the two extremes of tone color thus obtainable could be had, and, accordingly, it was difficult to achieve smooth control, and fine control of the tone.

SUMMARY OF THE INVENTION

It is accordingly an object of the present invention to do away with the aforementioned drawbacks of the prior art, and to provide a tone control for an electromagnetic pick-up for a stringed musical instrument such as a guitar with which it is possible to finely and easily adjust the tone color.

These and other objects of this invention are achieved by providing a tone control for an electromagnetic pick-up for a stringed musical instrument wherein the electromagnetic pick-up comprises at least a pair of coils and a magnet, comprising means for gradually switching the mutual connection between the coils from parallel to series or vice versa, the switching means comprising at least a ganged pair of rheostats of high rated resistance wherein at one extreme of travel of the sliding members of the ganged potentiometers the coils are connected in parallel and at the other extreme they are connected in series, and at intermediate positions a combination of parallel and series connection output components is outputted.

BRIEF DESCRIPTION OF THE DRAWINGS

FIG. 1 is a diagram showing the operation of an electromagnetic pick-up for a stringed musical instrument, such as is used in the subject invention;

FIG. 2 is a circuit diagram showing an electric circuit for a tone control according to an embodiment of the present invention; and FIG. 3 is a graph of the resistance characteristics of the rheostats 5 and 6 of FIG. 2.

In the figures, like references denote like or corresponding parts.

DESCRIPTION OF THE PREFERRED EMBODIMENTS

With the electromagnetic pick-ups commonly used in the art to convert the vibration of the strings of a stringed musical instrument, such as a guitar, into electrical energy which can be electrically controlled and electronically amplified, the vibration of the individual strings, which are typically made of a metal such as steel, is converted into oscillating electrical current, i.e. alternating current of a frequency corresponding substantially to that of the vibration of the string and of a magnitude directly proportional to the amplitude of the vibration of the string (6 in FIG. 1), by means of an electromagnetic pick-up (2 in FIG. 1) typically comprising two pick-up coils (A and B in FIG. 1) and a magnet (4 in FIG. 1).

FIG. 1 illustrates diagrammatically the principles of operation of such an electromagnetic pick-up 2. In FIG. 1, a string 6 is caused to vibrate by manipulation by a musician. To simplify the explanation of the principles, it is assumed that this vibration occurs as mechanical oscillation back and forth in a single plane $\dot{X}$ that traverses the lines of flux F as shown in FIG. 1. The flux is produced by a magnet 4. As the string 6 traverses the lines of flux F, it gives rise, according to electromagnetic principles, to a current in the coils A and B. That is to say, the vibrating string 6 causes a change in the flux in the coil A in the $\oplus$ direction as shown by the arrow $X\phi A$, and a current $I_1$ flows in the $\oplus$ direction as shown by the arrow $X_{IA}$. In the coil B, a change in the flux is caused in the $\oplus$ direction as shown by the arrow $X\phi B$, and a current $I_2$ flows in the $\oplus$ direction shown by the arrow $X_{IB}$. The current produced in the two coils is therefore equal to $I_1+I_2$, and flows in the $\oplus$ direction shown by the arrow $X_I(A+B)$. In the illustration the coils A and B are connected in series, but clearly they could also be connected in parallel with a modified phase relationship producing a modification of the tone color of the electrical output.

It should also be mentioned at this point that the pick-up construction employing two coils is particularly effective at eliminating the effects of extraneous magnetic noise. Looking, again, at FIG. 1, if at this point, some extraneous magnetic noise were to be introduced into the pick-up, and, without any relation to the flux from the magnet 2, the magnetic noise moves in the $\oplus$ direction shown by the arrow $X_n$, a change in the magnetic flux in the $\oplus$ direction would occur in the coil A, and a $\oplus$ direction current $I_{n1}$ would be generated. However, a $\ominus$ direction change would simultaneously occur in the magnetic flux in the coil B, and a $\ominus$ direction current $-I_{n2}$ would be generated. Adding the two currents $I_{n1}$ and $-I_{n2}$ produces a substantially zero result, and the currents would thus cancel each other out, leaving only the desired signal.

Turning now to the means of switching the mutual connection between the two coils of the pick-up, with a view to providing some control over the tone color, FIG. 2 illustrates a circuit for a tone control for an electromagnetic pick-up for a stringed musical instrument according to an embodiment of this invention. In the figure, an electromagnetic pick-up 2 comprising a pair of coils A and B and a magnet 4 is connected via four terminals 8, 10, 12, and 14 to a control circuit 16 comprising a ganged pair of tone control rheostats 18 and 26, a capacitive element 34 in association with one of the rheostats 26, and an output level controlling rheostat 36. The control circuit 16 is connected by the sliding member terminal 42 of the output rheostat 36 to an output jack 44.

The ganged pair of tone control rheostats 18 and 26 are mechanically connected by any suitable means (indicated diagrammatically by the broken line 9) so that the sliding of their respective sliding members 24 and 32 is synchronized such that the sliding members 24 and 32 move together from the extremities of their travel nearest the terminals 22 and 30 respectively towards the extremities nearest the terminals 20 and 28 respectively, or vice versa. In the illustrated embodiment the rheostat 18, one of the ganged pair, is arranged such that its effective resistance over substantially half of the travel of its sliding member from the extremity nearest the terminal 22 to a point midway along its length as measured across the terminals 22 and 24, is substantially zero ohms, and thereafter rises in linear fashion to a relatively high resistance (e.g. 500kΩ). The other rheostat 26 of the ganged pair is provided with logarithmic characteristics rising from substantially zero ohms at the extremity of its travel nearest the terminal 30 to maximum at the other extremity nearest the terminal 28 as measured across the terminals 30 and 32, with the steepest gradient about the center of the travel of the sliding member 32. In the illustrated embodiment the maximum resistance of the rheostat 26 is substantially the same as that of the rheostat 18 (e.g. 500kΩ), and the respective characteristics of the rheostats 18 and 26 are shown by the solid line and the broken line respectively in the graph in FIG. 3.

A capacitive element 34 is included between the terminal 30 of the rheostat 26 and earth to provide attenuation of high frequencies in inverse proportion to the resistance across the terminals 30 and 32. The cut-off frequency above which attenuation occurs may be determined as necessary by one skilled in the art by suitable selection of the capacitance of the capacitive element 34.

The terminals 12 and 14 of the coil A are respectively connected to the sliding member 32 of the rheostat 26 and the sliding member 24 of the rheostat 18. The sliding member 32 of the rheostat 26 is also connected to one of the stationary terminals 38 of the output rheostat 36. The terminals 8 and 10 of the coil B are respectively connected to earth and to one of the stationary terminals 22 of the rheostat 18. The stationary terminal 22 of the rheostat 18 is also connected to one of the stationary terminals 28 of the rheostat 26. The other stationary terminal 20 of the rheostat 18 is connected to earth, and the other stationary terminal 30 of the rheostat 26 is connected to earth via the aforementioned capacitive element 34. The other stationary terminal 4 of the output rheostat 36 is connected to earth.

With the circuit arrangement illustrated, when the sliding terminal members 24 and 32 are at the extremities nearest to the respective stationary terminals 22 and 30, the coils A and B are connected in series with the circuit going from earth to terminal 8 to coil B to terminal 10 to terminal 22 to sliding member 24 to terminal 14 to coil A to terminal 12 to terminal 38 to the output jack 44 via the output rheostat 36. In addition the connection is made via the sliding member 32 and the terminal 30 to the capacitive element 34 which parallels the output at the output jack 44 and provides high frequency attenuation as above described.

Next consider that the sliding members 24 and 32 have travelled to a point substantially midway along their length. The resistance between the terminal 22 and the sliding member 24 of the rheostat 18 is substantially OΩ as described above, and the resistance between the terminal 28 and the sliding member 32 of the rheostat 26 is still substantially high at 250kΩ, as shown in FIG. 3, thus in effect blocking the connection between the terminals 12 and 10, leaving the coils A and B in series. The capacitive element 34, however is in effect isolated by the resistance between the sliding member 32 and the terminal 30, and so substantially no high frequency attenuation occurs.

Subsequently, the sliding members 24 and 32 of the respective rheostats 18 and 26 are moved to the extremities of their travel nearest the terminals 20 and 28, placing the coils A and B in parallel connection with the circuit going from earth to terminal 8 to coil B to terminal 10 to terminal 28 to sliding member 32 to terminal 38, and the circuit going from earth to terminal 20 to sliding member 24 to terminal 14 to coil A to terminal 12 to terminal 38. Terminal 38 is connected to an output jack 44 via the output rheostat 36.

Thus, in summary, the operation of the tone control circuit 16 can be described as follows. The sliding members 24 and 32 start at the extremities of the mechanical ranges of the rheostats closest to the terminals 22 and 30, respectively, at which point the coils are connected in series, and a degree of attenuation of high frequencies is effected by the capacitive element 34. As the sliding members 24 and 32 move towards the mid-points of their respective ranges of travel the coils remain effectively in series as the resistance across the terminal 22 and the sliding member 24 remains substantially zero, and the resistance across the terminal 28 and the sliding member 32 remains high, while the degree of high frequency attenuation due to the capacitive element 34 gradually approaches substantially zero as the resistance across the terminal 30 and the sliding member 32 increase. Beyond the mid-point, continuing in the same direction, the resistance across the terminal 20 and the sliding member 24 decreases, gradually directing the terminal 14 of the coil A to a direct connection with earth, parallelling the connection to earth via the terminal 8 of the coil B, placing the coils A and B in parallel connection. Further, the reduction of the resistance across the terminal 28 and the sliding member 32 to substantially zero brings the terminal 10 of the coil B into direct contact with the terminal 38 of the output rheostat 36, parallelling the connection between the terminal 12 of the coil A and the aforementioned terminal 38, thus completing the parallel connection of the two coils A and B.

Thus the connection between the coils A and B is gradually switched from series to parallel connection, and, obviously, moving the ganged rheostats 18 and 26 in the opposite direction would gradually achieve the reverse switching, with the gradual switching providing a gradual transition between the tone colors that respectively characterize series and parallel connection of the coils of an electromagnetic pick-up for a stringed musical instrument, thus providing a tone control therefor.

It is to be understood that although only a specific embodiment of the present invention has been illustrated and described, various changes may be made in the form, details, arrangement and proportion of the parts of the pick-up and control unit, and therefore the present invention may be applicable to various machines other than that exemplified above, without departing from the scope of the invention which consists of the matter shown and described herein and set forth in the appended claims.

What is claimed is:

1. A tone control for an electromagnetic pick-up for a stringed musical instrument wherein said electromagnetic pick-up comprises at least a pair of coils and a magnet, comprising means for gradually switching the mutual connection between said pair of coils from parallel connection to series connection and vice versa to alter the tone color characteristics of the output from said electromagnetic pick-up, said means for gradually switching comprising at least a ganged pair of rheostats of high rated resistance wherein at one extreme of travel of sliding members of the ganged rheostats the coils are connected in parallel, and at the other extreme of travel of the sliding members of the ganged rheostats the coils are connected in series, and at intermediate positions thereof a combination of parallel and series connection components is achieved in a proportion determined by the relative position of the sliding members of said rheostats.

2. A tone control for an electromagnetic pick-up for a stringed musical instrument as claimed in claim 1 wherein a capacitive element is included between earth and one stationary terminal of one of said rheostats of said ganged pair of potentiometers, to provide a variable degree of high frequency tone attenuation in accordance with the position of the sliding member of said rheostat.

3. A tone control for an electromagnetic pick-up for a stringed musical instrument as claimed in claim 1 wherein one of said rheostats of said ganged pair of rheostats has substantially zero resistance over substantially one half of its travel from one extreme of its travel to a point substantially midway along its travel, and the resistance of the rheostat then increases linearly to the maximum rated resistance at the opposite extreme of its travel.

4. A tone control for an electromagnetic pick-up for a stringed musical instrument as claimed in claim 3 wherein a capacitive element is included between earth and one stationary terminal of one of said rheostats of said ganged pair of rheostats other than said rheostat with substantially zero resistance over substantially half its travel, whereby said ganged pair of rheostats operates to provide variable high frequency attenuation over substantially half its range of travel, and alter the tone color by switching the mutual connection between said pair of coils over the remaining portion of its range of travel.

* * * * *